US006589089B1

(12) United States Patent
Glass et al.

(10) Patent No.: US 6,589,089 B1
(45) Date of Patent: Jul. 8, 2003

(54) SELF-RIGHTING FLOTATION SEAT FOR AN INFANT

(76) Inventors: Elizabeth Glass, 179 Sequams Lane Center, West Islip, NY (US) 11795; James Mandato, 2667 Cheshire Dr., Baldwin, NY (US) 11510

( * ) Notice: Subject to any disclaimer, the term of this patent is extended or adjusted under 35 U.S.C. 154(b) by 0 days.

(21) Appl. No.: 10/038,369

(22) Filed: Oct. 19, 2001

(51) Int. Cl.[7] ..... B63C 9/08
(52) U.S. Cl. ..... 441/130; 297/250.1
(58) Field of Search ..... 441/129, 130, 441/131, 132; 297/184.13, 250.1

(56) References Cited

U.S. PATENT DOCUMENTS

| | | | | |
|---|---|---|---|---|
| 4,725,253 A | | 2/1988 | Politte | |
| 4,798,551 A | | 1/1989 | Dumonceaux et al. | |
| 4,799,910 A | * | 1/1989 | Kellough | 441/131 |
| 4,997,231 A | * | 3/1991 | Smith | 297/184.13 |
| 5,409,411 A | * | 4/1995 | Schrieber | 441/80 |
| 5,514,020 A | | 5/1996 | Gainforth | |
| 5,730,490 A | * | 3/1998 | Mortenson | 297/184.13 |
| 5,766,052 A | * | 6/1998 | Metro et al. | 441/130 |
| 5,993,276 A | | 11/1999 | Ponton et al. | |
| 6,036,563 A | * | 3/2000 | Walker | 441/130 |
| 6,296,305 B1 | * | 10/2001 | Lamka et al. | 297/184.13 |
| 6,412,865 B1 | * | 7/2002 | Bedard | 297/250.1 |
| 6,482,060 B1 | * | 11/2002 | Gorny et al. | 441/130 |

* cited by examiner

*Primary Examiner*—Stephen Avila
*Assistant Examiner*—Andrew Wright
(74) *Attorney, Agent, or Firm*—Richard L. Miller

(57) ABSTRACT

A self-righting floatation seat for an infant that includes a body holding the infant and a harness detachably attached to the body. The body includes a lower portion receiving the infant, a handle extending upwardly from the lower portion, and a canopy detachably attached to the handle and the lower portion by a pair of quick disconnect clips and shields the head of the infant. The lower portion has an inner floor so configured so as to allow the infant to be in a reclining position, is separated from the lower portion by floatation foam, and has a plurality of perches extending upwardly therefrom to which the harness is attached. The lower portion has a pair drain holes in which a pair of check valves are disposed. The harness is a five-point harness including a pair of shoulder straps, a crotch strap, and a pair of waist straps.

11 Claims, 2 Drawing Sheets

FIG.5
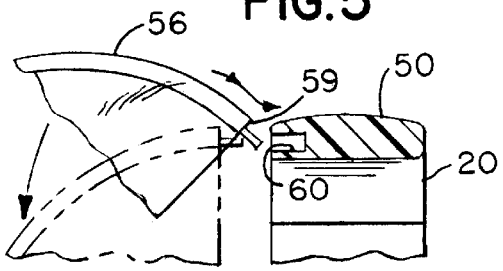
FIG.6
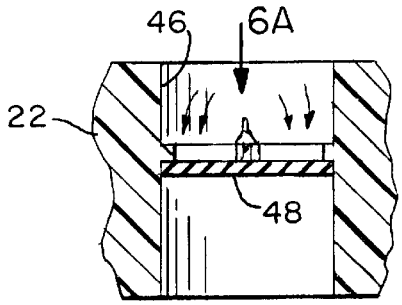
FIG.7
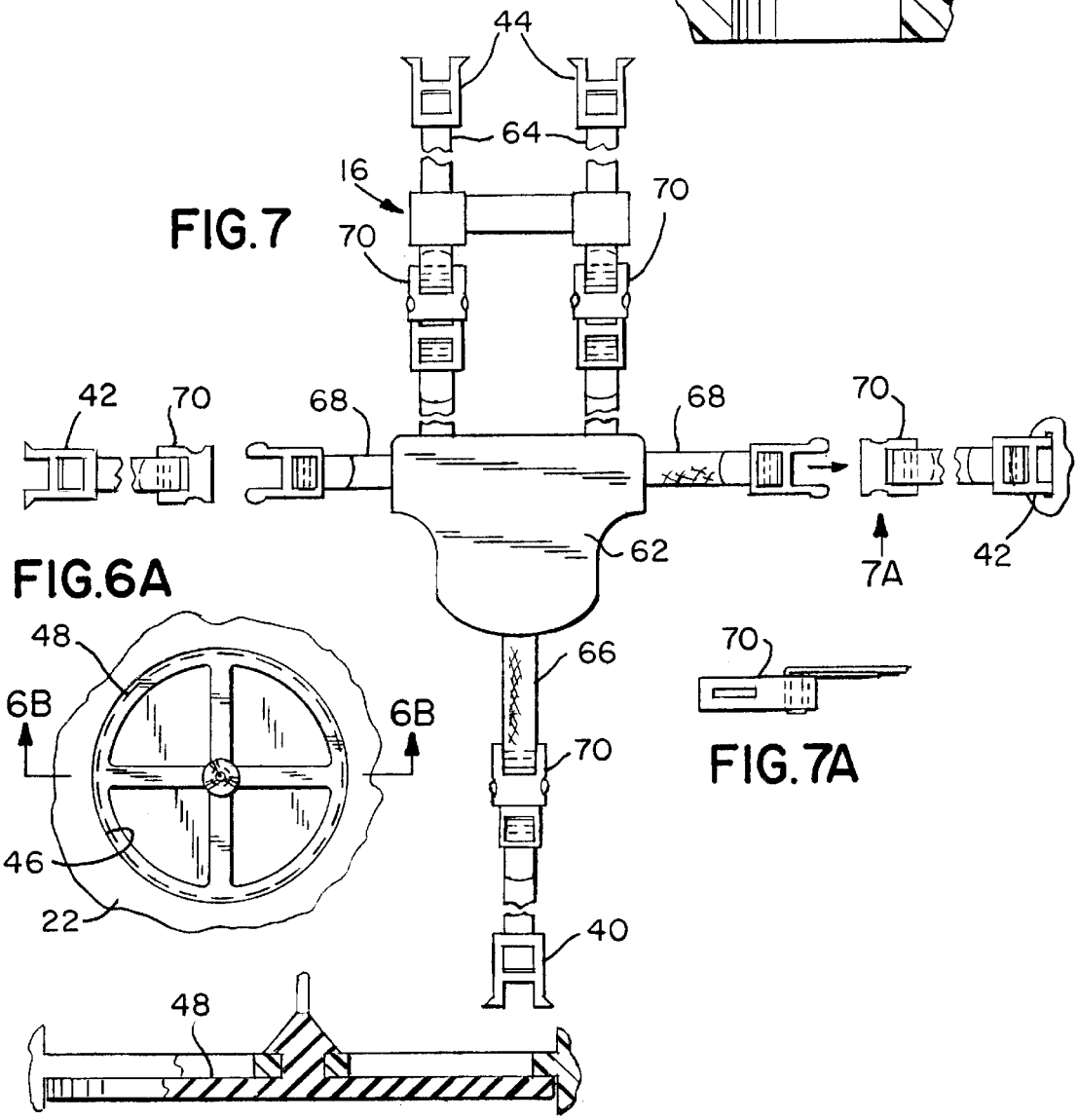
FIG.6A
FIG.7A
FIG.6B

SELF-RIGHTING FLOTATION SEAT FOR AN INFANT

BACKGROUND OF THE INVENTION

1. Field of the Invention

The present invention relates to a self-righting floatation device. More particularly, the present invention relates to a self-righting floatation seat for an infant.

2. Description of the Prior Art

Numerous innovations for floating infant seats have been provided in the prior art that will be described. Even though these innovations may be suitable for the specific individual purposes to which they address, however, they differ from the present invention.

A first example, U.S. Pat. No. 4,725,253 to Politte teaches a personal flotation device for protecting the life of an infant human that has a support housing with a back rest, a seat portion, and side wings co-extensive with each. A protective hood is pivotally mounted from the upper portion of the backrest wings. A support stand having a ballast weight contained at the lower end thereof is pivotally mounted from the area joining the backrest and set portion of the device. This permits accurate adjustment for various sizes and weights of children with whom the device is designed to be used. Appropriate signalling and attention attracting apparatus is also incorporated with this device. Also, a shoulder harness, seat belt, crotch belt and adjusting buckles therefor are provided.

A second example, U.S. Pat. No. 4,798,551 to Dumonceaux et al. teaches a floatable carrier for a baby, comprising interior walls forming a baby receiving cavity, exterior walls fastened to the interior walls and forming a buoyancy space therebetween, said interior wall including a bottom wall, and a ballast secured to and extending downwardly from the bottom wall.

A third example, U.S. Pat. No. 5,514,020 to Gainforth teaches a child- or infant-sized safety seat with relatively horizontal seat and relatively vertical back support elements designed with flotation effecting materials sufficient to keep said child or infant at the water's surface and with critically positioned and apportioned (relative to the weight of the back and seat support elements and the anticipated weight of the child) counter-weight effecting materials to result in that portion of the vertical back support element supporting the child's head and shoulders well above the water's surface. The safety seat is preferably constructed by injecting a semi-rigid, resilient polyurethane foam into a die cast mold into which the weight materials have been pre-positioned to result in the up-righting of the safety seat at the water's surface, and the foam, upon rising and curing, forms around the weighted material to fix its position.

A fourth example, U.S. Pat. No. 5,993,276 to Ponton et al. teaches a floating child seat assembly that includes a chair member having a seat portion and a backrest portion perpendicularly depending therefrom. Upper and lower inflatable flotation devices are secured to each side of the chair member to suspend the chair member on the surface of a body of water. A weight is secured to the bottom surface of the seat portion to maintain the chair member in an upright position. The backrest potion has a pair of opposing adjustable straps extending therefrom for securing the child within the chair member. An umbrella is removably secured to the backrest portion to shield a child from sunlight.

It is apparent that numerous innovations for floating infant seats have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

Accordingly, an object of the present invention is to provide a self-righting floatation seat for an infant that avoids the disadvantages of the prior art.

Another object of the present invention is to provide a self-righting floatation seat for an infant that is simple and inexpensive to manufacture.

Still another object of the present invention is to provide a self-righting floatation seat for an infant that is simple to use.

Briefly stated, still yet another object of the present invention is to provide a self-righting floatation seat for an infant that includes a body holding the infant and a harness detachably attached to the body. The body includes a lower portion receiving the infant, a handle extending upwardly from the lower portion, and a canopy detachably attached to the handle and the lower portion by a pair of quick disconnect clips and shields the head of the infant. The lower portion has an inner floor so configured so as to allow the infant to be in a reclining position, is separated from the lower portion by floatation foam, and has a plurality of perches extending upwardly therefrom to which the harness is attached. The lower portion has a pair drain holes in which a pair of check valves are disposed. The harness is a five-point harness including a pair of shoulder straps, a crotch strap, and a pair of waist straps.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

DESCRIPTION OF THE DRAWING

The figures of the drawing are briefly described as follows:

FIG. 5 is an enlarged diagrammatic side elevational view, in partial section, of the area generally enclosed by the dotted curve identified by arrow 5 in FIG. 2 of a canopy lock of the present invention;

FIG. 6 is an enlarged diagrammatic cross sectional view of the area generally enclosed by the dotted curve identified by arrow 6 in FIG. 4 of the drain check valve of the present invention;

FIG. 6A is a diagrammatic top plan view taken generally in the direction of arrow 6A in FIG. 6;

FIG. 6B is a diagrammatic cross sectional view taken along line 6B—6B in FIG. 6A;

FIG. 7 is a diagrammatic top plan view of the harness of the present invention; and FIG. 7A is an enlarged diagrammatic side elevational view of the area generally enclosed by the dotted curve identified by arrow 7A in FIG. 7 of a buckle of the harness of the present invention shown in FIG. 7.

LIST OF REFERENCE NUMERALS UTILIZED IN THE DRAWING

Figure 1:
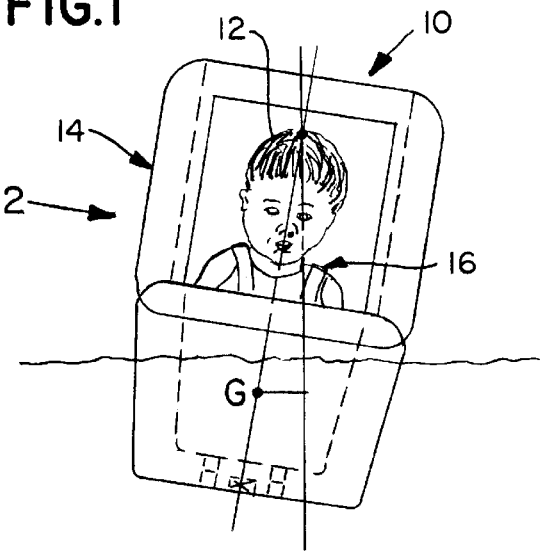
FIG. 1 is a diagrammatic front elevational view of the body of the present invention holding an infant.

10 self-righting floatation seat of present invention for infant 12
12 infant
14 body for holding infant 12
16 harness for maintaining infant 12 in body 14
18 lower portion of body 14 for receiving infant 12
20 handle for carrying self-righting floatation seat 10
22 bottom wall of lower portion 18 of body 14
24 pair of side walls of lower portion 18 of body 14
26 back wall of lower portion 18 of body 14
28 front wall of lower portion 18 of body 14
30 peripheral rim of lower portion 18 of body 14
32 inner floor of lower portion 18 of body 14
34 back portion of inner floor 32 of lower portion 18 of body 14 for having back of infant 12 rest thereupon so as to allow infant 12 to be in a reclining position in lower portion 18 of body 14
36 front portion of inner floor 32 of lower portion 18 of body 14 for having legs of infant 12 rest thereupon so as to allow infant 12 to be comfortable when in reclining position in lower portion 18 of the body 14
37 floatation foam separating inner floor 32 from lower portion 18 of body 14
38 plurality of perches on inner floor 32 of lower portion 18 of body 14
40 front perch 40 of plurality of perches 38
42 pair of side perches of plurality of perches 38
44 pair of a plurality of back perches of plurality of perches 38
46 pair of drain holes in lower portion 18 of body 14
48 pair of check valves in pair of drain holes 46 in lower portion 18 of body 14, respectively
50 uppermost portion of handle 20
52 back portion of peripheral rim 30 of lower portion 18 of body 14
54 front portion of peripheral rim 30 of lower portion 18 of body 14
56 canopy of body 14 for shielding head of infant 12
58 pair of quick disconnect clips of canopy 56 of body 14
59 uppermost/forwardmost portion of canopy 56 of body 14
60 pair of recesses in uppermost portion 50 of handle 20
62 breast plate of harness 16 for overlying breast of infant 12
64 pair of shoulder straps of harness 16 for overlying shoulders of infant 12
66 crotch strap of harness 16 for overlying crotch of infant 12
68 pair of waist straps of harness 16 for overlying waist of infant 12
70 quick disconnect buckle dividing each of pair of shoulder straps 64 of harness 16, crotch strap 66 of harness 16, and pair of waist straps 68 of harness 16

DETAILED DESCRIPTION OF THE PREFERRED EMBODIMENT

Referring now to the figures, in which like numerals indicate like parts, and particularly to FIG. 1, the self-righting floatation seat of the present invention is shown generally at 10 for an infant 12.

The overall configuration of the self-righting floatation seat 10 can best be seen in FIG. 1, and as such, will be discussed with reference thereto.

The self-righting floatation seat 10 comprises a body 14 that is floatative and is for holding the infant 12, and a harness 16 that is detachably attached to the body 14 and is for maintaining the infant 12 in the body 14.

Figure 4:
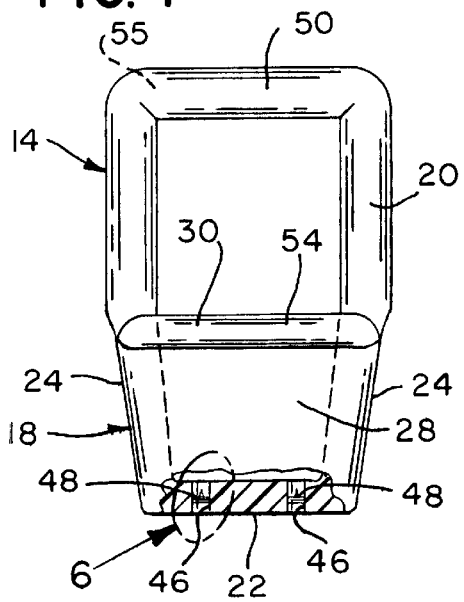
FIG. 4 is a diagrammatic front elevational view of the present invention.
Figure 2:
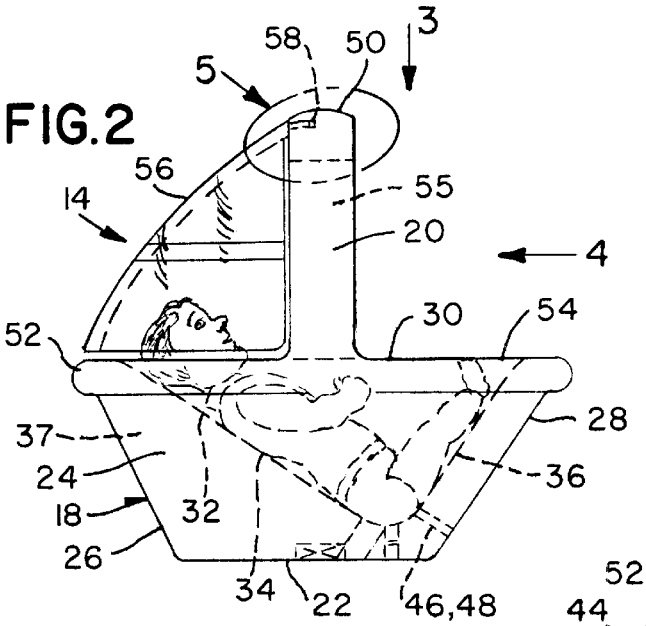
FIG. 2 is a diagrammatic side elevational view taken generally in the direction of arrow 2 in FIG. 1.
Figure 3:
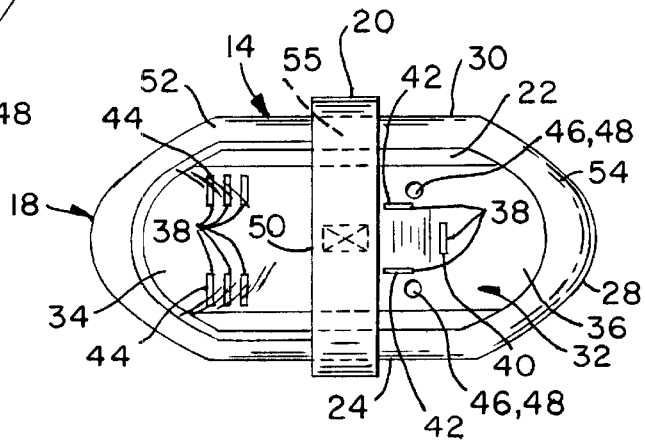
FIG. 3 is a diagrammatic top plan view taken generally in the direction of arrow 3 in FIG. 2.

The general configuration of the body 14 can best be seen in FIGS. 2–4, and as such, will be discussed with reference thereto.

The body 14 comprises a lower portion 18 for receiving the infant 12, and a handle 20 that extends upwardly from the lower portion 18 thereof and is for carrying the self-righting floatation seat 10.

The lower portion 18 of the body 14 has a bottom wall 22, a pair of side walls 24 that extend upwardly from the bottom wall 22 thereof, a back wall 26 that extends upwardly and inclingly outwardly from the bottom wall 22 thereof, and a front wall 28 that extends upwardly and inclingly outwardly from the bottom wall 22 thereof.

The bottom wall 22, the pair of side walls 24, the back wall 26, and the front wall 28 of the lower portion 18 of the body 14 terminate in an peripheral rim 30.

The lower portion 18 of the body 14 further has an inner floor 32.

The inner floor 32 has a back portion 34 that inclines downwardly from the peripheral rim 30 of the lower portion 18, at the back wall 26 thereof, to the bottom wall 22 of the lower portion 18, at the front wall 28 thereof, and is for having the back of the infant 12 rest thereupon so as to allow the infant 12 to be in a reclining position in the lower portion 18 of the body 14.

The inner floor 32 further has a front portion 36 that extends along the front wall 28 of the lower portion 18 of the body 14 and is for having the legs of the infant 12 rest thereupon so as to allow the infant 12 to be comfortable when in the reclining position in the lower portion 18 of the body 14.

The inner floor 32 is separated from the lower portion 18 of the body 14 by floatation foam 37.

The inner floor 32 further has a plurality of perches 38 that extend upwardly therefrom and to which the harness 16 is attached.

Each perch 38 is inverted U-shaped.

The plurality of perches 38 comprise a front perch 40 that is disposed laterally on the front portion 36 of the inner floor 32, a pair of side perches 42 that are disposed longitudinally on the front portion 36 of the inner floor 32, between the front perch 40 and the handle 20, and to either side of the front perch 40, and a pair of a plurality of back perches 44 that are disposed laterally on the back portion 34 of the inner floor 32 and are laterally spaced-apart.

The lower portion 18 of the body 14 further has a pair drain holes 46 that extend from the front portion 36 of the inner floor 32 thereof through the bottom wall 22 thereof.

The lower portion 18 of the body 14 further has a pair of check valves 48 that are disposed in the pair of drain holes 46, respectively.

The handle 20 of the body 14 is inverted U-shaped, extends vertically upwardly from the pair of side walls 24 of the lower portion 18 of the body 14 to an uppermost portion 50, divides the peripheral rim 30 into a back portion 52 and a front portion 54, and is filled with floatation foam 55.

The body 14 further comprises a canopy 56 that is detachably attached to the handle 20 and the back portion 52 of the peripheral rim 30 by a pair of quick disconnect clips 58 and is for shielding the head of the infant 12.

The specific configuration of the canopy 56 can best be seen in FIG. 5, and as such, will be discussed with reference thereto.

The canopy 56 has an uppermost/forwardmost portion 59 from which the pair of quick disconnect clips 58 extend and detachably engage in a pair of recesses 60 in the uppermost portion 50 of the handle 20, respectively.

The specific configuration of each check valve 48 can best be seen in FIGS. 6, 6A, and 6B, and as such, will be discussed with reference thereto.

Each check valve 48 is of the neoprene rubber single diaphragm type, typically used in inflatable life rafts and SCUBA regulators.

The specific configuration of the harness 16 can best be seen in FIGS. 7 and 7A, and as such, will be discussed with reference thereto.

The harness 16 is a five-point harness that comprises a breast plate 62 for overlying the breast of the infant 12, a pair of shoulder straps 64 that extend upwardly from the breast plate 62 to an appropriately aligned pair of the pair of a plurality of back perches 44 and are for overlying the shoulders of the infant 12, a crotch strap 66 that depends from the breast plate 62 to the front perch 40 and is for overlying the crotch of the infant 12, and a pair of waist straps 68 that extend sideways from opposite sides of the breast plate 62 to the pair of side perches 42, respectively, and are for overlying the waist of the infant 12.

Each of the pair of shoulder straps 64, the crotch strap 66, and the pair of waist straps 68 is divided in two by a quick disconnect buckle 70 for allowing separation of the straps of the harness 16 for insertion and removal of the infant 12.

It will be understood that each of the elements described above, or two or more together, may also find a useful application in other types of constructions differing from the types described above.

While the invention has been illustrated and described as embodied in a self-righting floatation seat for an infant, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A self-righting floatation seat for an infant, comprising:

a) a body; and b) a harness;

wherein said body is floatative;

wherein said body is for holding the infant;

wherein said harness is detachably attached to said body; and said harness is for maintaining the infant in said body, wherein said body comprises a lower portion;

wherein said lower portion of said body is for receiving the infant;

wherein said body comprises a handle;

wherein said handle extends upwardly from said lower portion of said body; and wherein said handle of said body is for carrying said self-righting floatation seat, wherein said lower portion of said body has a bottom wall;

wherein said lower portion of said body has a pair of side walls;

wherein said pair of side walls extend upwardly from said bottom wall of said lower portion of said body;

wherein said lower portion of said body has a back wall;

wherein said back wall extends upwardly and incliningly outwardly from said bottom wall of said lower portion of said body;

wherein said lower portion of said body has a front wall; and wherein said front wall extends upwardly and incliningly outwardly from said bottom wall of said lower portion of said body, wherein said bottom wall, said pair of side walls, said back wall, and said front wall of said lower portion of said body terminate in an peripheral rim, wherein said lower portion of said body has an inner floor, wherein said inner floor of said lower portion of said body has a front portion;

wherein said front portion of said inner floor extends along said front wall of said lower portion of said body; and wherein said front portion of said inner floor is for having the legs of the infant rest thereupon so as to allow the infant to be comfortable when in the reclining position in said lower portion of said body, wherein said lower portion of said body has a pair drain holes; and wherein said pair of drain holes extend from said front portion of said inner floor through said bottom wall of said lower portion of said body, wherein said lower portion of said body has a pair of check valves; and wherein said pair of check valves are disposed in said pair of drain holes, respectively.

2. The seat as defined in claim 1, wherein said inner floor of said lower portion of said body has a back portion;

wherein said back portion of said inner floor inclines downwardly from said peripheral rim of said lower portion of said body, at said back wall thereof, to said bottom wall of said lower portion of said body, at said front wall thereof; and wherein said back portion of said inner floor is for having the back of the infant rest thereupon so as to allow the infant to be in a reclining position in said lower portion of said body.

3. The seat as defined in claim 1, wherein said inner floor is separated from said lower portion of said body by floatation foam.

4. The seat as defined in claim 1, wherein said inner floor of said lower portion of said body has a plurality of perches;

wherein said plurality of perches comprise a front perch;

wherein said front perch is disposed laterally on said front portion of said inner floor;

wherein said plurality of perches comprise a pair of side perches;

wherein said pair of side perches are disposed longitudinally on said front portion of said inner floor;

wherein said pair of side perches are disposed between said front perch and said handle;

wherein said pair of side perches are disposed to either side of said front perch;

wherein said plurality of perches comprise a pair of a plurality of back perches;

wherein said pair of a plurality of back perches are disposed laterally on said back portion of said inner floor; and wherein said pair of a plurality of back perches are laterally spaced-apart.

5. The seat as defined in claim 4, wherein said harness is a five-point harness;

wherein said five-point harness comprises a breast plate;

wherein said breast plate is for overlying the breast of the infant;

wherein said five-point harness comprises a pair of shoulder straps;

wherein said pair of shoulder straps extend upwardly from said breast plate to an appropriately aligned pair of said pair of a plurality of back perches;

wherein said pair of shoulder straps are for overlying the shoulders of the infant;

wherein said five-point harness comprises a crotch strap;

wherein said crotch strap depends from said breast plate to said front perch;

wherein said crotch strap is for overlying the crotch of the infant;

wherein said five-point harness comprises a pair of waist straps;

wherein said pair of waist straps extends sideways from opposite sides of said breast plate to said pair of side perches, respectively; and wherein said pair of waist straps are for overlying the waist of the infant.

6. The seat as defined in claim 5, wherein each of said pair of shoulder straps, said crotch strap, and said pair of waist straps of said harness is divided in two by a quick disconnect buckle; and wherein said quick disconnect buckles are for allowing separation of said straps of said harness for insertion and removal of the infant.

7. The seat as defined in claim 1, wherein said handle of said body is inverted U-shaped;

wherein said handle of said body extends vertically upwardly from said pair of side walls of said lower portion of said body to an uppermost portion; and wherein said handle of said body divides said peripheral rim into a back portion and a front portion.

8. The seat as defined in claim 7, wherein said body comprises a canopy;

wherein said canopy is detachably attached to said handle and said back portion of said peripheral rim by a pair of quick disconnect clips; and wherein said canopy is for shielding the head of the infant.

9. The seat as defined in claim 8, wherein said canopy has an uppermost/forwardmost portion;

wherein said pair of quick disconnect clips extend from said uppermost/forwardmost portion of said canopy; and wherein said pair of quick disconnect clips detachably engage in a pair of recesses in said uppermost portion of said handle, respectively.

10. The seat as defined in claim 1, wherein said handle of said body is filled with floatation foam.

11. The seat as defined in claim 1, wherein each check valve is of a neoprene rubber single diaphragm type.

* * * * *